US008251684B2

(12) United States Patent
Shiba et al.

(10) Patent No.: US 8,251,684 B2
(45) Date of Patent: Aug. 28, 2012

(54) TROCHOID PUMP PROVIDING AXIAL REGULATION OF A DRIVING SHAFT

(75) Inventors: Yuji Shiba, Osaka (JP); Akio Ikeda, Osaka (JP); Satoshi Hattori, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 494 days.

(21) Appl. No.: 12/300,002

(22) PCT Filed: Apr. 27, 2007

(86) PCT No.: PCT/JP2007/059204

§ 371 (c)(1),
(2), (4) Date: Feb. 18, 2009

(87) PCT Pub. No.: WO2007/129615

PCT Pub. Date: Nov. 15, 2007

(65) Prior Publication Data

US 2009/0185939 A1 Jul. 23, 2009

(30) Foreign Application Priority Data

May 9, 2006 (JP) ..... 2006-130782

(51) Int. Cl.
*F01C 1/10* (2006.01)
*F03C 2/00* (2006.01)
*F03C 4/00* (2006.01)

(52) U.S. Cl. ..... 418/166; 418/171; 464/182; 403/359.6; 403/383

(58) Field of Classification Search ..... 418/61.3, 418/206.1, 166, 171; 464/182; 403/359.1, 403/359.6, 383

See application file for complete search history.

(56) References Cited

U.S. PATENT DOCUMENTS 4,171,939 A * 10/1979 Harwath ..... 418/170
4,685,871 A 8/1987 Harwath
5,263,818 A * 11/1993 Ito et al. ..... 418/171

(Continued)

FOREIGN PATENT DOCUMENTS

CN 1113540 A 12/1995

(Continued)

OTHER PUBLICATIONS

English translation of Notification of the First Office Action for corresponding CN appl. No. 200780021641.3 issued Jul. 20, 2010, 5 pages.

(Continued)

*Primary Examiner* — Theresa Trieu

(74) *Attorney, Agent, or Firm* — Sterne, Kessler, Goldstein & Fox P.L.L.C.

(57) ABSTRACT

A trochoid pump, comprising a driving shaft, wherein a drive gear comprising of a bevel gear is fixed on one end thereof and an inner rotor is penetrated onto the other end thereof, an outer rotor, the center of which is decentered to the inner rotor, wherein both rotors are covered with the cap and the casing, a first regulatory structure, wherein the driving shaft or a means of control fixed on the driving shaft regulates an one-way movement to the casing, a second regulatory structure, wherein an end face on the other side of the driving shaft is engaged with one end of the cap and regulates the other way movement of the cap, wherein the thrust of the driving shaft is axially regulated by the first regulatory structure and by the second regulatory structure.

1 Claim, 14 Drawing Sheets

(a)

(b)

U.S. PATENT DOCUMENTS

| | | | | | |
|---|---|---|---|---|---|
| 5,316,457 | A | * | 5/1994 | Harwath | 418/171 |
| 5,340,293 | A | * | 8/1994 | Yasuda et al. | 418/171 |

FOREIGN PATENT DOCUMENTS

| | | | | |
|---|---|---|---|---|
| CN | 2604539 | Y | | 2/2004 |
| JP | 55-101787 | | | 8/1980 |
| JP | 2-115986 | | | 9/1990 |
| JP | 4-040179 | | | 4/1992 |
| JP | 10213079 | A | * | 8/1998 |
| JP | 10288166 | A | | 10/1998 |
| JP | 2002-098065 | | | 4/2002 |
| JP | 2002-276319 | | | 9/2002 |

OTHER PUBLICATIONS

Patent Abstracts of Japan, English language abstract for Publication No. JP 2002-098065, Trochoid Pump, published Apr. 5, 2002.

Patent Abstracts of Japan, English language abstract for Publication No. JP 2002-276319, Structure for Supporting Rotating Shaft of Fluid Pump, published Sep. 25, 2002.

International Search Report for International Application No. PCT/JP2007/059204, Japanese Patent Office, mailed Jul. 10, 2007, 2 pgs.

English translation of Notification of the Second Office Action for corresponding CN appl. No. 200780021641.3 issued Feb. 22, 2011, 3 pages.

* cited by examiner (a)

(b)

(a)

(b)

(c)

(a)

(b)

(a)

(b)

TROCHOID PUMP PROVIDING AXIAL REGULATION OF A DRIVING SHAFT

BACKGROUND OF THE INVENTION

1. Field of the Invention

The present invention relates to a construction technique for a trochoid pump applicable in a fuel injection pump, in a fuel injection device of a diesel engine.

2. Related Art

Conventionally, there are well-known trochoid pumps. For example, as described in JP 2002-98065, a trochoid pump, which is applicable as a fuel injection pump in a fuel injection device of a diesel engine, is disclosed. The diesel engine needs to pressurize fuel at high pressure and inject them so as to deliver them into the air compressed at high pressure in a combustion chamber. The fuel injection device assumes pressurizing and sending fuel. The fuel injection device includes the fuel injection pump that pressurizes fuel at high pressure and sends them into injection nozzles, as well as injection nozzles that inject fuel into cylinders.

The prior art on a trochoid pump 200 will be described with reference to FIG. 14 as a cross-sectional view showing a simplified cross section. The trochoid pump 200 is covered with a casing 206 and a removable cap 205, and an inner rotor 201 and an outer rotor 202 are rotatably provided therein.

A drive gear 207 as a bevel gear is annealed and fixed into, or pressed into one end of a driving shaft 203. The other end of the driving shaft 203 is penetrated into the central portion of the inner rotor 201 and supported in the cap 205. A rotational direction of the inner rotor 201 is regulated by a drive pin 218.

A camshaft 209 is driven via the gear by a crankshaft (not shown) and it vertically moves a plunger (not shown) by rotating a cam (not shown) formed on the camshaft 209 and rotates the drive gear 208. In this regard, the camshaft 209 drives the driving shaft 203 via the bevel gear composed of the drive gears 207, 208.

Due to the above-mentioned construction, as the inner rotor 201 is driven by the camshaft 209, the outer rotor 202 is rotated. Because the centers of the inner rotor 201 and the outer rotor 202 are decentered and the number of teeth of the inner rotor 201 are one less than the number of teeth of the outer rotor 202, the fuel oil is interposed between the rotors 201 and 202 and is delivered from an inlet port (not shown) to an outlet port (not shown).

Due to the above-mentioned construction of the trochoid pump 200, the driving shaft 203 is regulated by the cap 205 and the drive gear 208 in a thrust direction (in a direction of arrow in FIG. 10).

However, when the drive gear 208 as the bevel gear is abraded, the driving shaft 203 is offset in the thrust direction, thereby increasing a backlash (a gap when the gears are enmeshed). The more the backlash increases, the more the abrasion of the drive gears 207 and 208 increase, thereby shortening the life cycle of a product.

The problem so as to be solved is to prevent the offset of the driving shaft in the thrust direction in the trochoid pump.

SUMMARY OF THE INVENTION

The problem so as to be solved by the present invention is as mentioned above. Next, the means of solving the problem will be described.

The present invention comprises a trochoid pump, comprising a driving shaft, wherein a drive gear comprising of a bevel gear is fixed on one end thereof and a inner rotor is penetrated onto the other end thereof, an outer rotor, the center of which is decentered to the inner rotor, wherein both rotors are covered with the cap and the casing, a first regulatory structure, wherein the driving shaft or a means of control fixed on the driving shaft regulates a one-way movement to the casing, a second regulatory structure, wherein an end face of the other side of the driving shaft is engaged with one end of the cap and regulates the other way movement of the cap, wherein the thrust of the driving shaft is axially regulated by the first regulatory structure and by the second regulatory structure.

In the present invention, one part of the driving shaft is a different diameter shaft which is larger than the diameter of the driving shaft, and the first regulatory structure is constructed to join the end face of the different diameter shaft with that of the inner rotor.

In the present invention, a double-sided portion is provided on the different diameter shaft, a joint is disposed on the inner rotor, wherein it is fixed with the double-sided portion, and the inner rotor is driven by the different diameter shaft.

In the present invention, a specially shaped drive pin, which a tetrahedral shape is provided on both sides thereof and a joint, which the tetrahedral shape is fixed on to the inner rotor, wherein the first regulatory structure is constructed to join one side of the tetrahedral shape with one side of the joint, and the inner rotor is driven by the tetrahedral shape.

The present invention shows the following effects.

In the present invention, because a position of the thrust direction of the driving shaft is determined, an increase in the abrasion of the drive gear can be prevented when the drive gear is abraded. The movable scope of the driving shaft can be adjusted by single piece of the trochoid pump, thereby improving the operability of the trochoid pump.

In the present invention, the effect can be realized with a simple construction wherein one part of the driving shaft is different in diameter from the other portion of it.

In the present invention, the rotational direction of the inner rotor can be regulated toward the driving shaft without a conventional drive pin, thereby reducing the number of components of the trochoid pump.

In the present invention, the conventional drive pin has two functions, thereby reducing the number of components of the trochoid pump. The thrust direction of the driving shaft and the rotational direction of the inner rotor are regulated by the proximal contacts thereof, thereby advancing the regulatory accuracy and increasing the durability due to the reduction in the abrasion of the contact portions.

DETAILED DESCRIPTION OF THE INVENTION

Next, embodiments of the present invention will be described.

Figure 1:
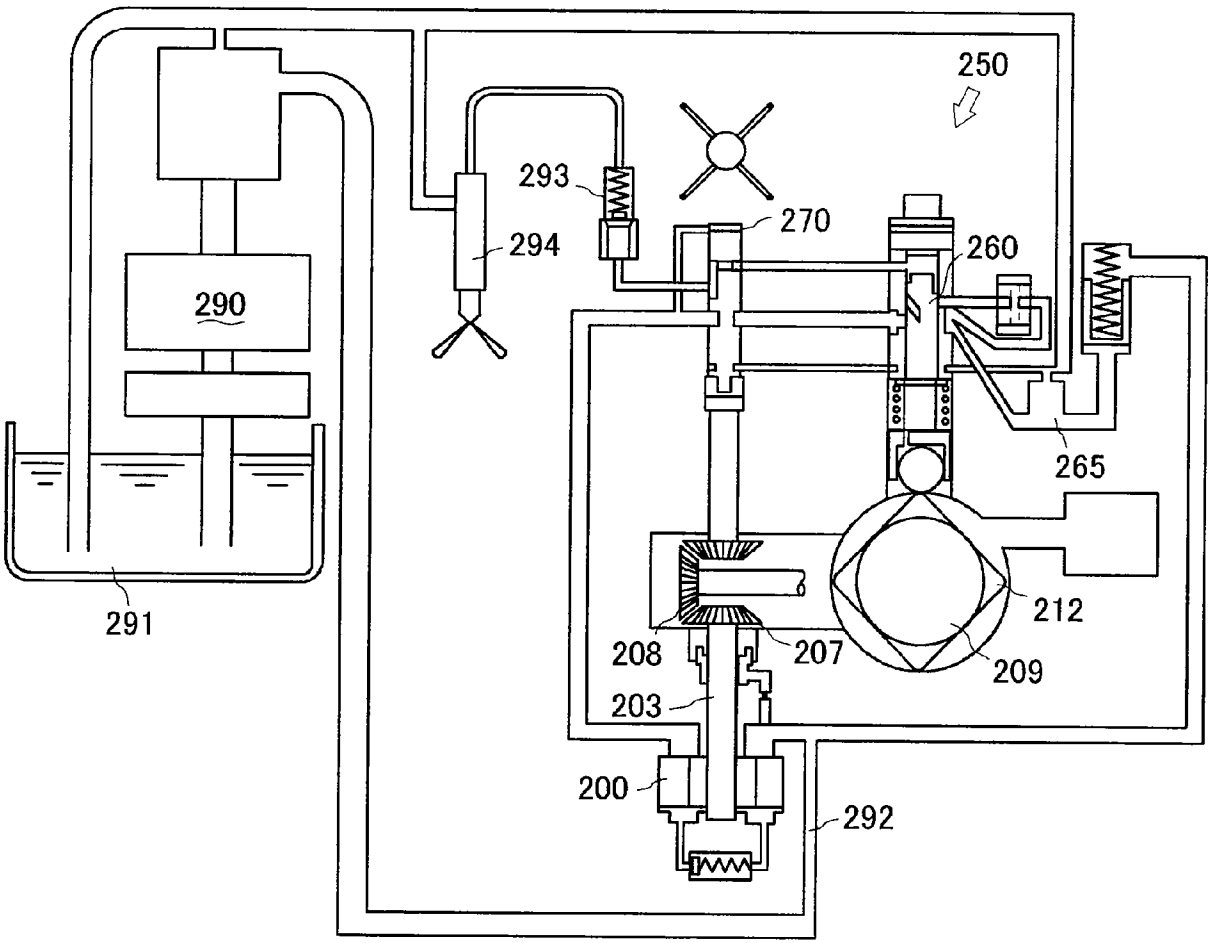
FIG. 1 is a schematic diagram showing a distributor type pump that a trochoid pump of the present invention is applicable.
Figure 2:
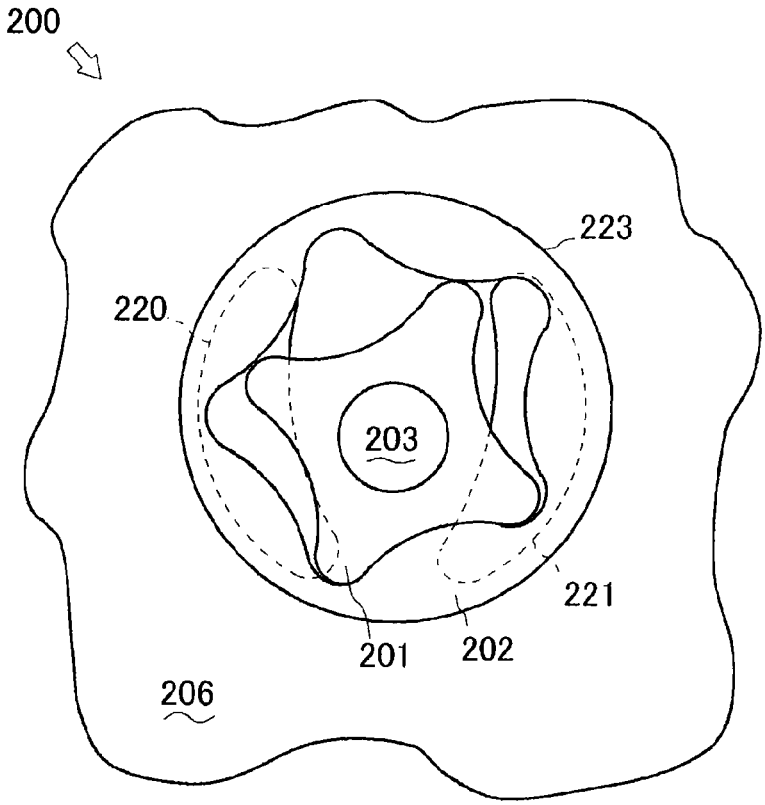
FIG. 2 is a pattern elevational view of the trochoid pump.

FIG. 1 is a schematic diagram showing a distributor type pump that a trochoid pump of the present invention is applicable and FIG. 2 is a pattern elevational view of the trochoid pump.

Figure 3:
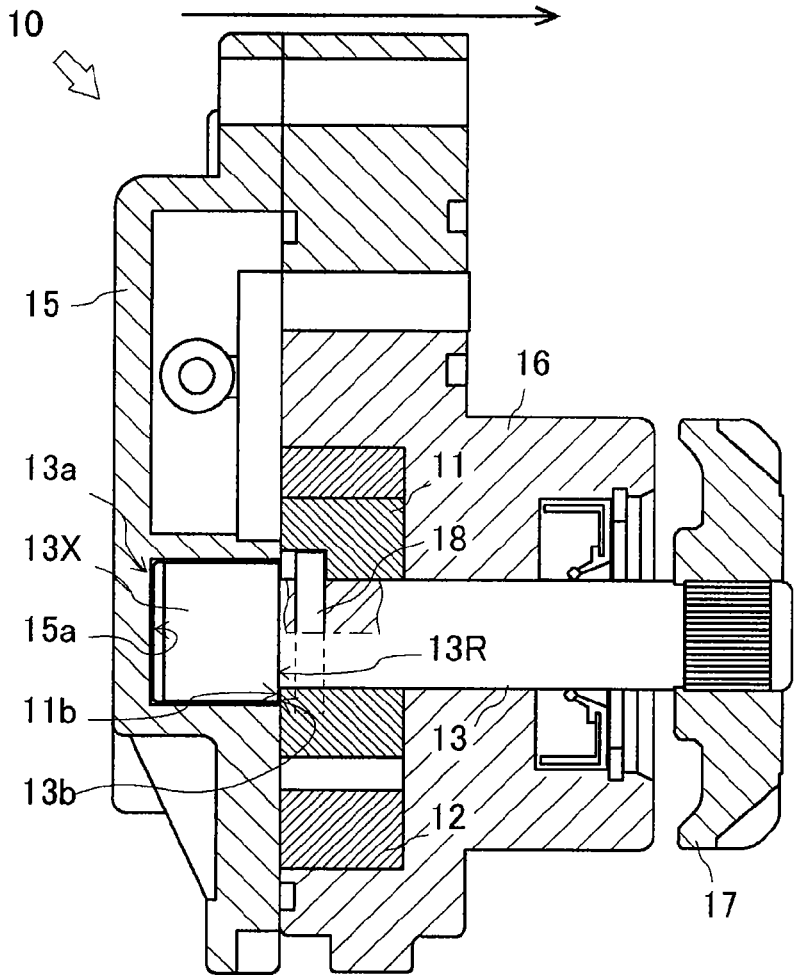
FIG. 3 (*a*) is a pattern cross-sectional diagram of the trochoid pump in the first embodiment and FIG. 3 (*b*) is an elevational view of a driving shaft to which an inner rotor is attached.
Figure 3:
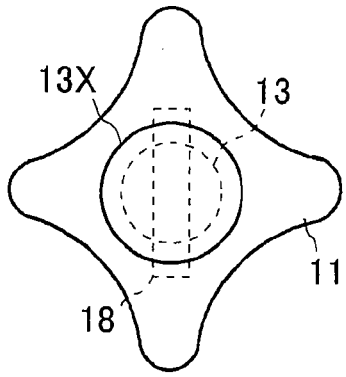

FIG. 3 (*a*) is a pattern cross-sectional diagram of the trochoid pump in the first embodiment and FIG. 3 (*b*) is an elevational view of a driving shaft to which an inner rotor is attached.

Figure 4:
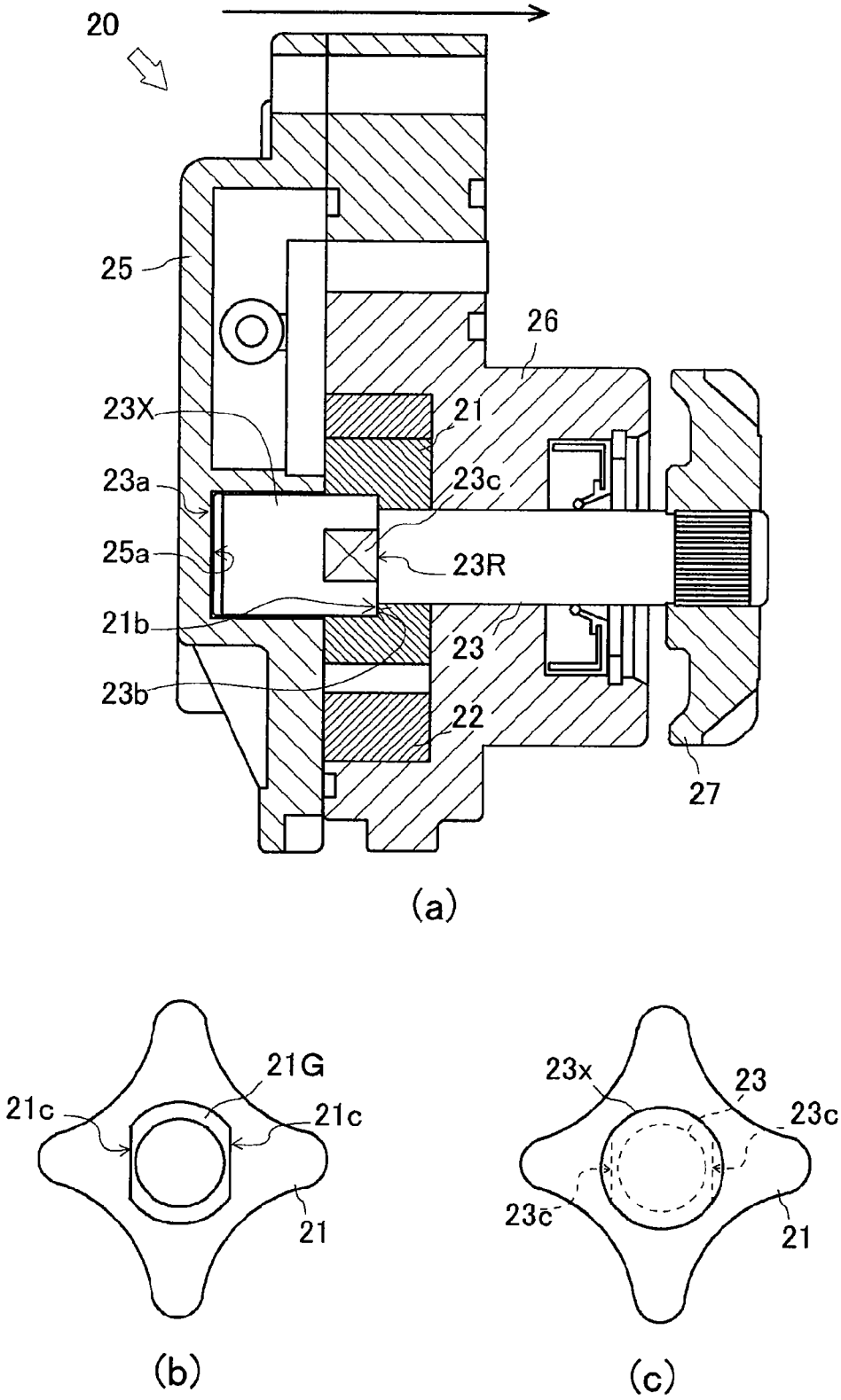
FIG. 4 (*a*) is a pattern cross-sectional diagram of the trochoid pump in the second embodiment, FIG. 4 (*b*) is an elevational view of the inner rotor, and FIG. 4 (*c*) is an elevational view of a driving shaft to which the inner shaft is attached.

FIG. 4 (*a*) is a pattern cross-sectional diagram of the trochoid pump in the second embodiment, FIG. 4 (*b*) is an elevational view of the inner rotor, and FIG. 4 (*c*) is an elevational view of a driving shaft to which the inner shaft is attached.

Figure 5:
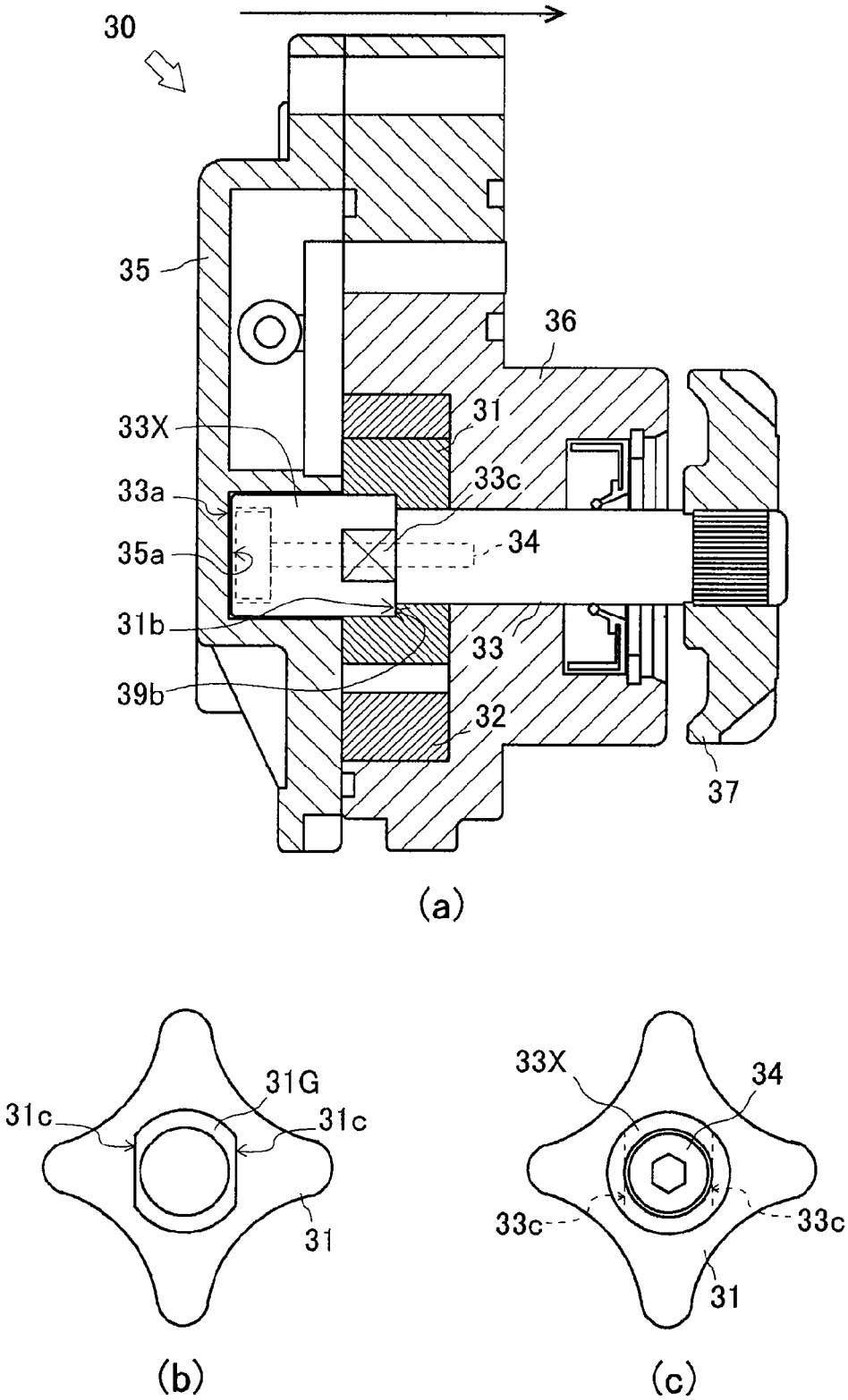
FIG. 5 (*a*) is a pattern cross-sectional diagram of the trochoid pump in the third embodiment, FIG. 5(*b*) is an elevational view of the inner rotor, and FIG. 5 (*c*) is an elevational view of a driving shaft to which the inner shaft is attached.

FIG. 5 (*a*) is a pattern cross-sectional diagram of the trochoid pump in the third embodiment, FIG. 5(*b*) is an elevational view of the inner rotor, and FIG. 5 (*c*) is an elevational view of a driving shaft to which the inner shaft is attached.

Figure 6:
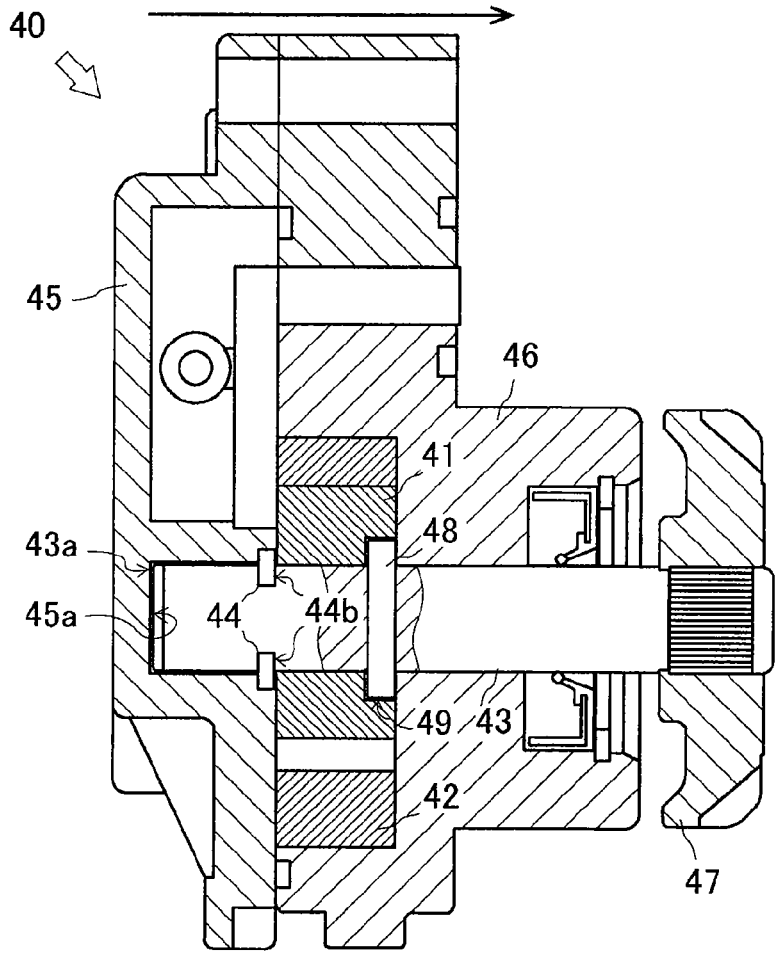
FIG. 6 (*a*) is a pattern cross-sectional diagram of the trochoid pump in the fourth embodiment, FIG. 6 (*b*) is an elevational view of a driving shaft to which an inner rotor is attached and FIG. 6 (*c*) is an elevational view of a horseshoe piece.
Figure 6:
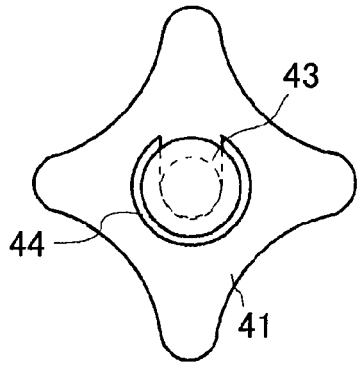
Figure 6:
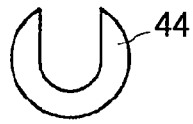

FIG. 6 (*a*) is a pattern cross-sectional diagram of the trochoid pump in the fourth embodiment, FIG. 6 (*b*) is an elevational view of a driving shaft to which an inner rotor is attached and FIG. 6 (*c*) is an elevational view of a horseshoe piece.

Figure 7:
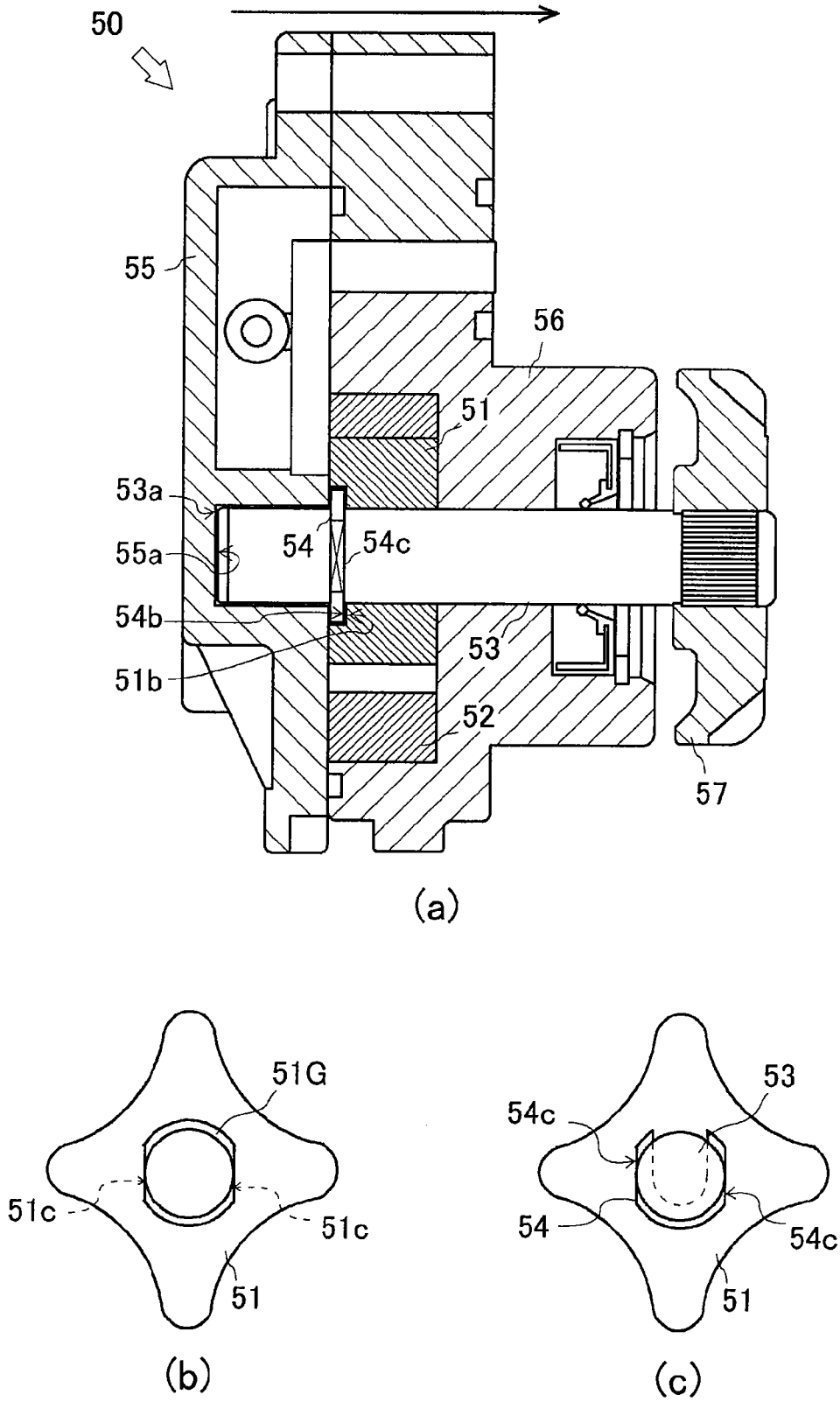
FIG. 7 (*a*) is a pattern cross-sectional diagram of the trochoid pump in the fifth embodiment, FIG. 7 (*b*) is an elevational view of an inner rotor and FIG. 7 (*c*) is an elevational view of a driving shaft to which an inner rotor is attached.

FIG. 7 (*a*) is a pattern cross-sectional diagram of the trochoid pump in the fifth embodiment, FIG. 7 (*b*) is an elevational view of an inner rotor and FIG. 7 (*c*) is an elevational view of a driving shaft to which an inner rotor is attached.

Figure 8:
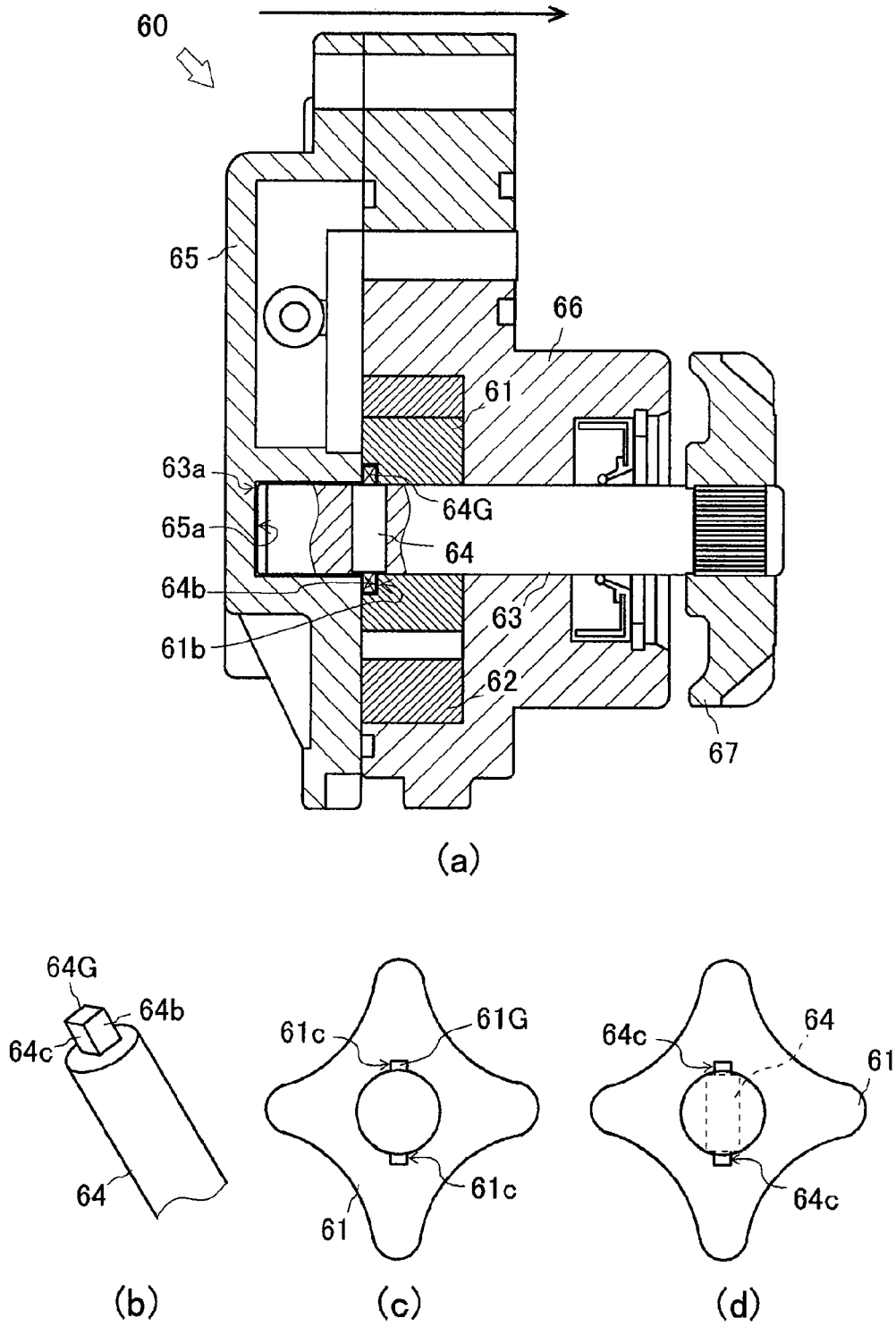
FIG. 8 (*a*) is a pattern cross-sectional diagram of the trochoid pump in the sixth embodiment, FIG. 8 (*b*) is a perspective view of a specially shaped drive pin likewise, FIG. 8(*c*) is an elevational view of an inner rotor and FIG. 8(*d*) is an elevational view of a driving shaft to which an inner rotor is attached.

FIG. 8 (*a*) is a pattern cross-sectional diagram of the trochoid pump in the sixth embodiment, FIG. 8 (*b*) is a perspective view of a specially shaped drive pin, FIG. 8(*c*) is an elevational view of an inner rotor and FIG. 8(*d*) is an elevational view of a driving shaft to which an inner rotor is attached.

Figure 9:
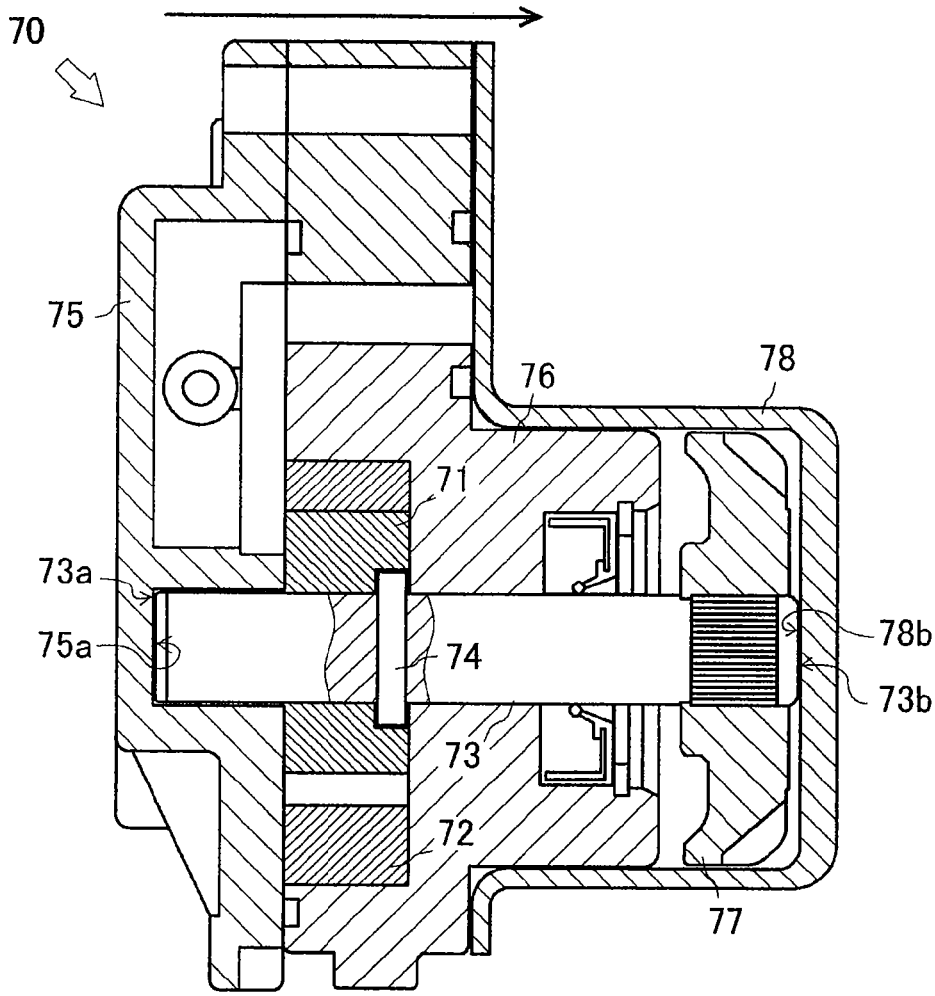
FIG. 9 (*a*) is a pattern cross-sectional diagram of the trochoid pump in the seventh embodiment and FIG. 9 (*b*) is a rear view of the trochoid pump.
Figure 9:
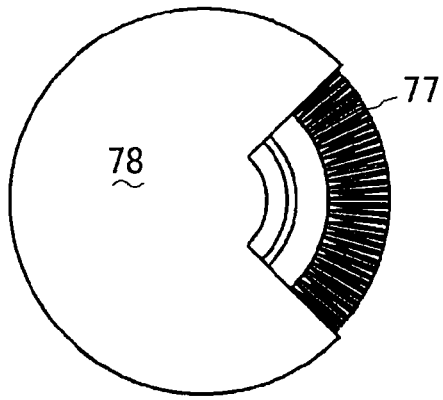

FIG. 9 (*a*) is a pattern cross-sectional diagram of the trochoid pump in the seventh embodiment and FIG. 9 (*b*) is a rear view of the trochoid pump.

Figure 10:
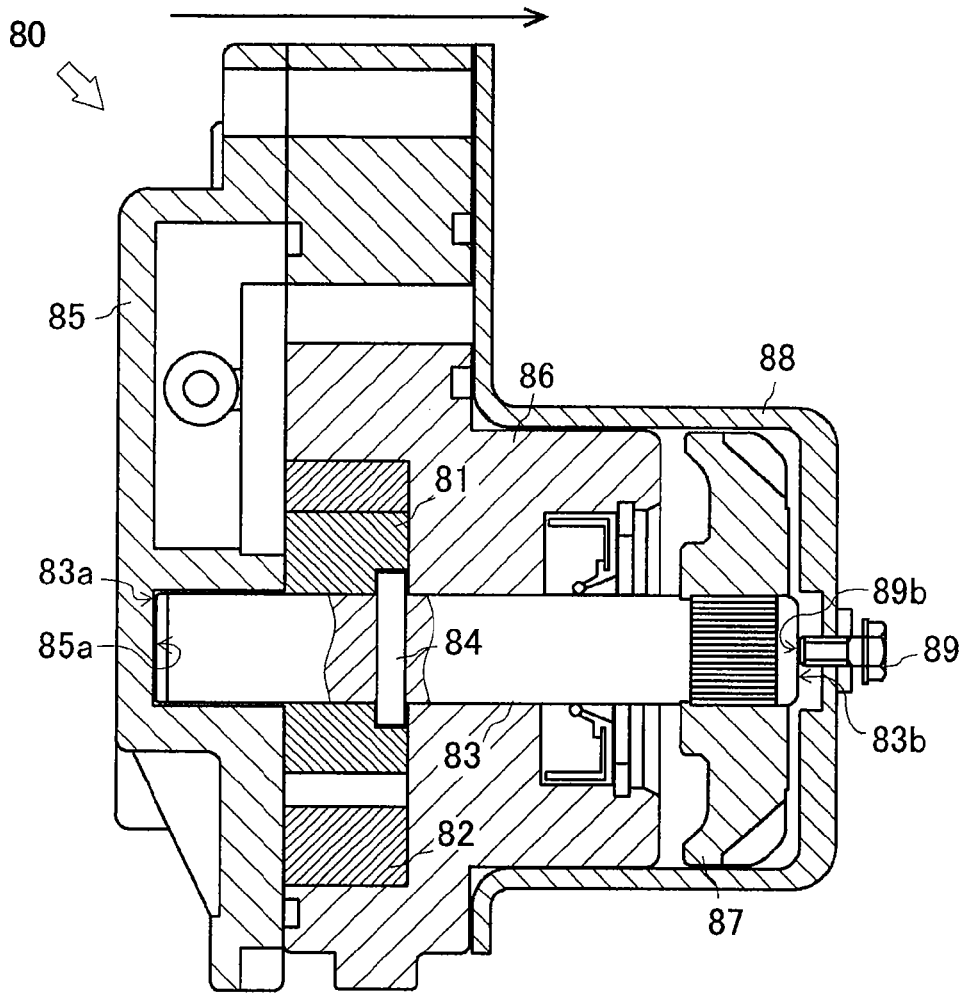
FIG. 10 (*a*) is a pattern cross-sectional diagram of the trochoid pump in the eighth embodiment and FIG. 10 (*b*) is a rear view of the trochoid pump.
Figure 10:
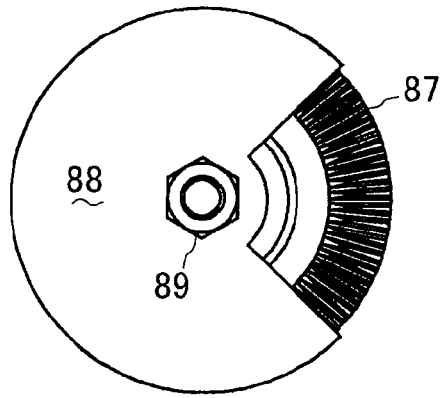

FIG. 10 (*a*) is a pattern cross-sectional diagram of the trochoid pump in the eighth embodiment and FIG. 10 (*b*) is a rear view of the trochoid pump.

Figure 11:
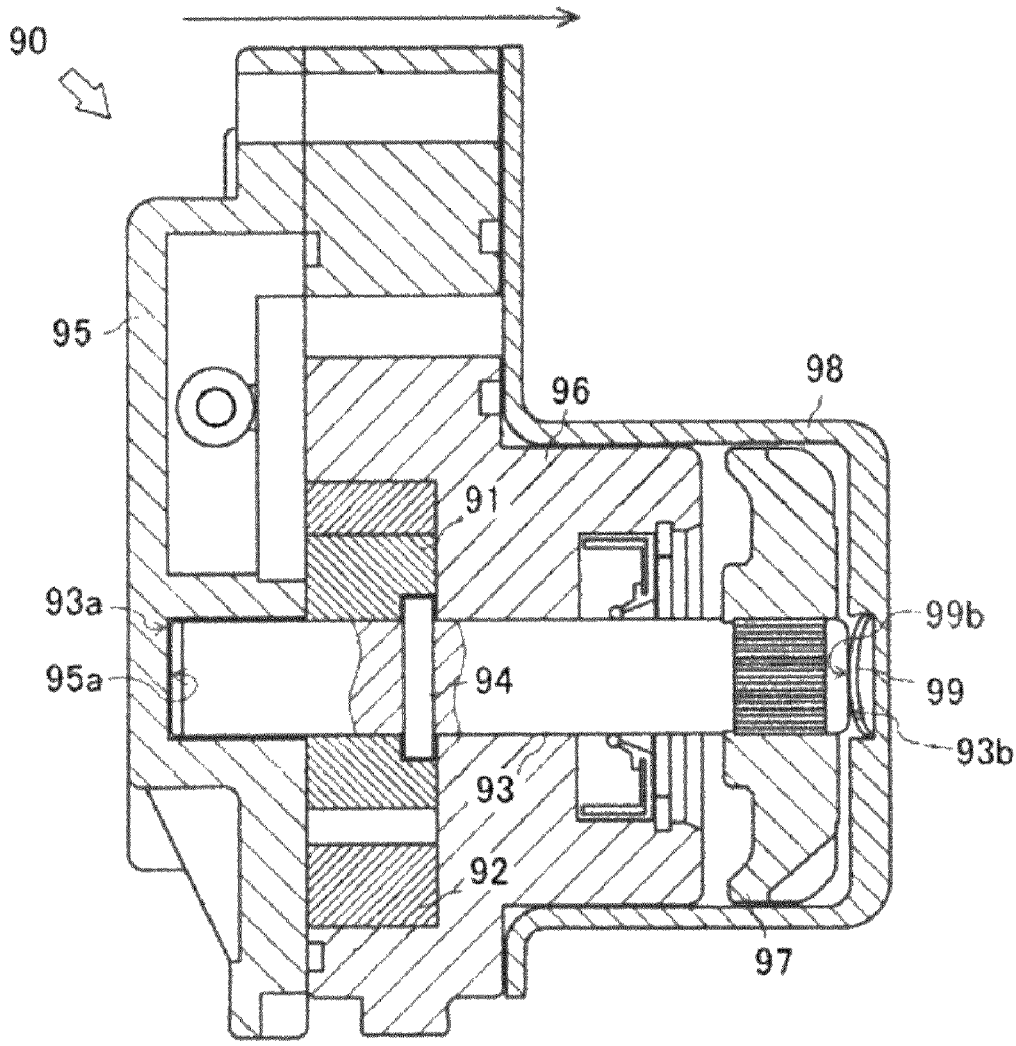
FIG. 11 (*a*) is a pattern cross-sectional diagram of the trochoid pump in the ninth embodiment.

FIG. 11 (*a*) is a pattern cross-sectional diagram of the trochoid pump in the ninth embodiment.

Figure 12:
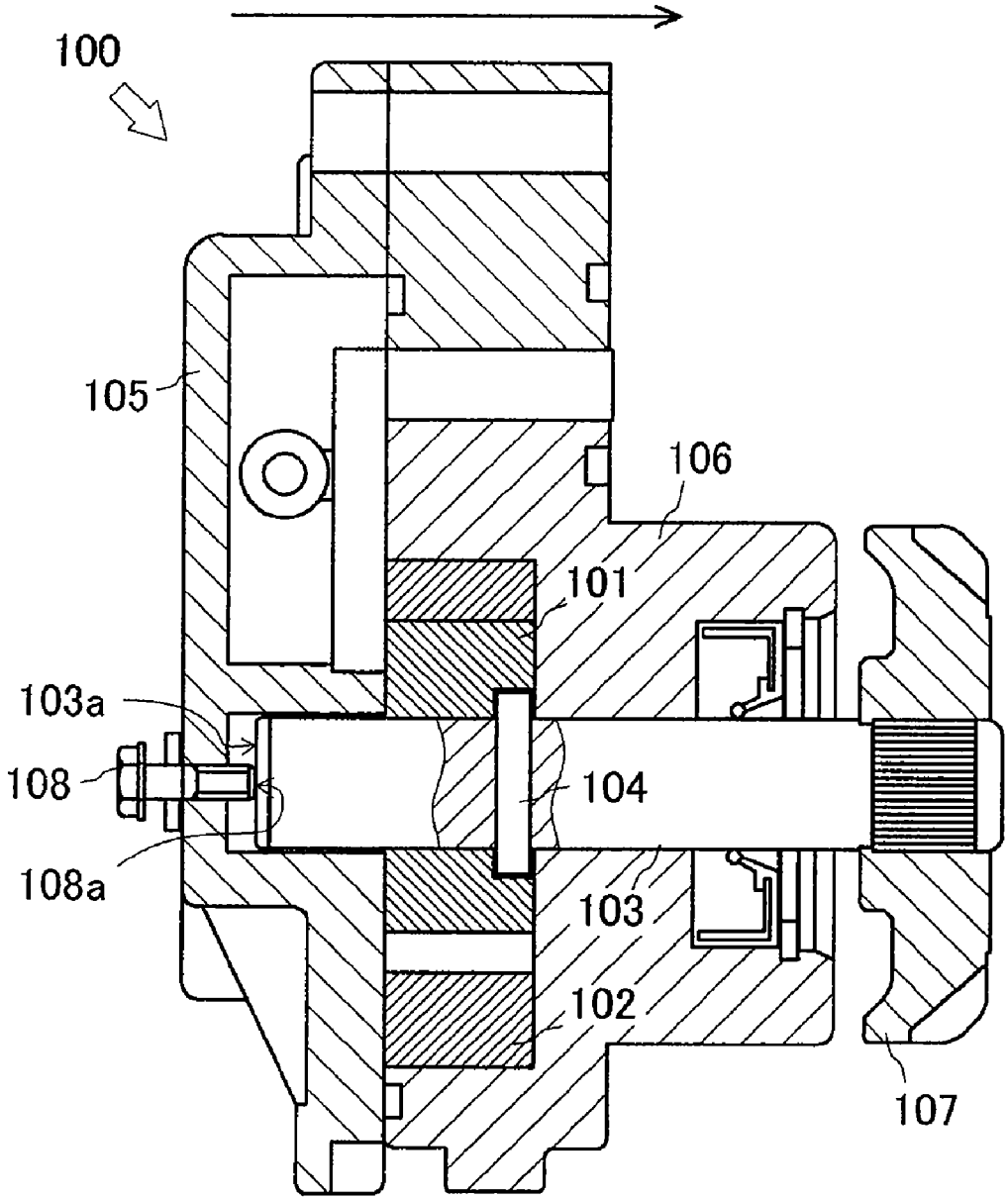
FIG. 12 is a pattern cross-sectional diagram of the trochoid pump in the tenth embodiment.
Figure 13:
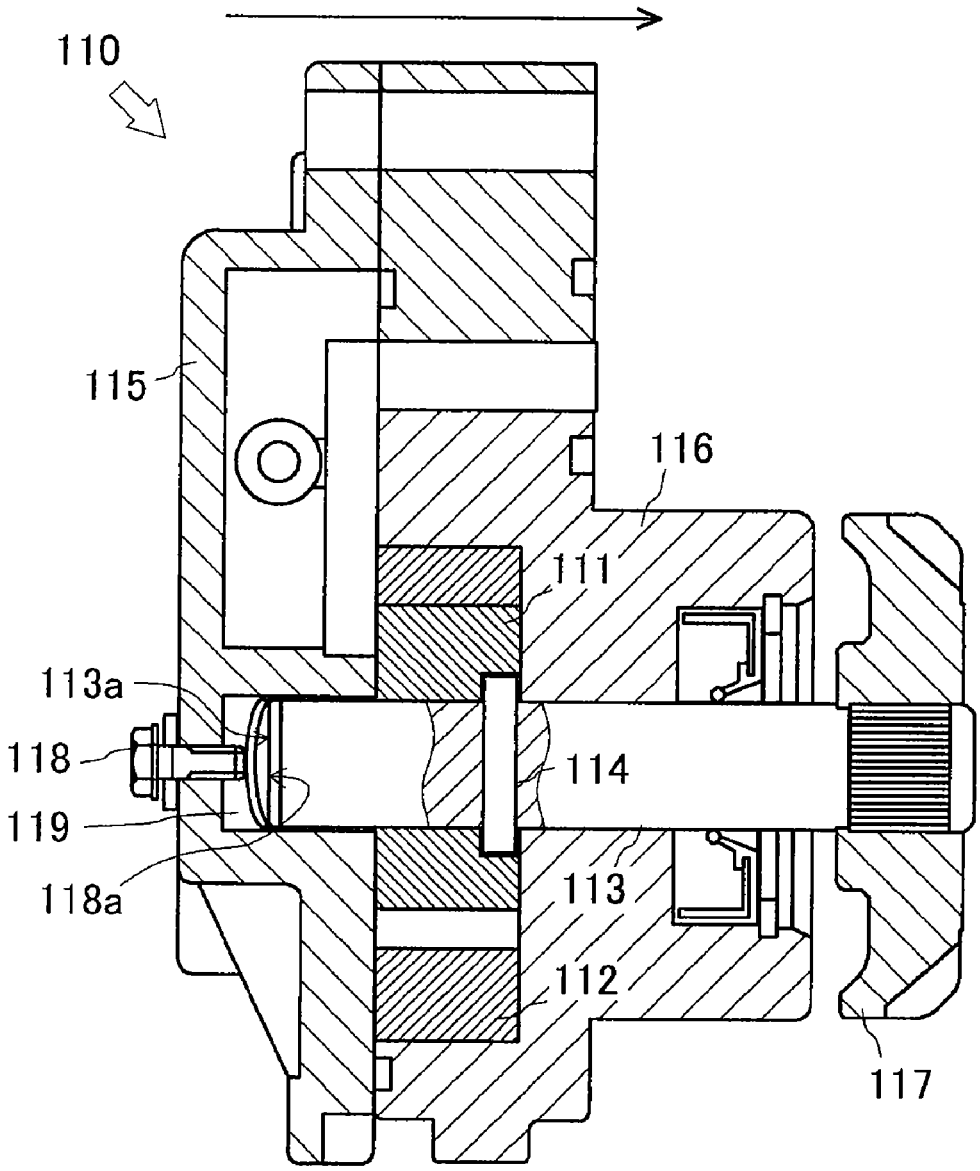
FIG. 13 is a pattern cross-sectional diagram of the trochoid pump in the eleventh embodiment.

FIG. 12 is a pattern cross-sectional diagram of the trochoid pump in the tenth embodiment and FIG. 13 is a pattern cross-sectional diagram of the trochoid pump in the eleventh embodiment.

Figure 14:
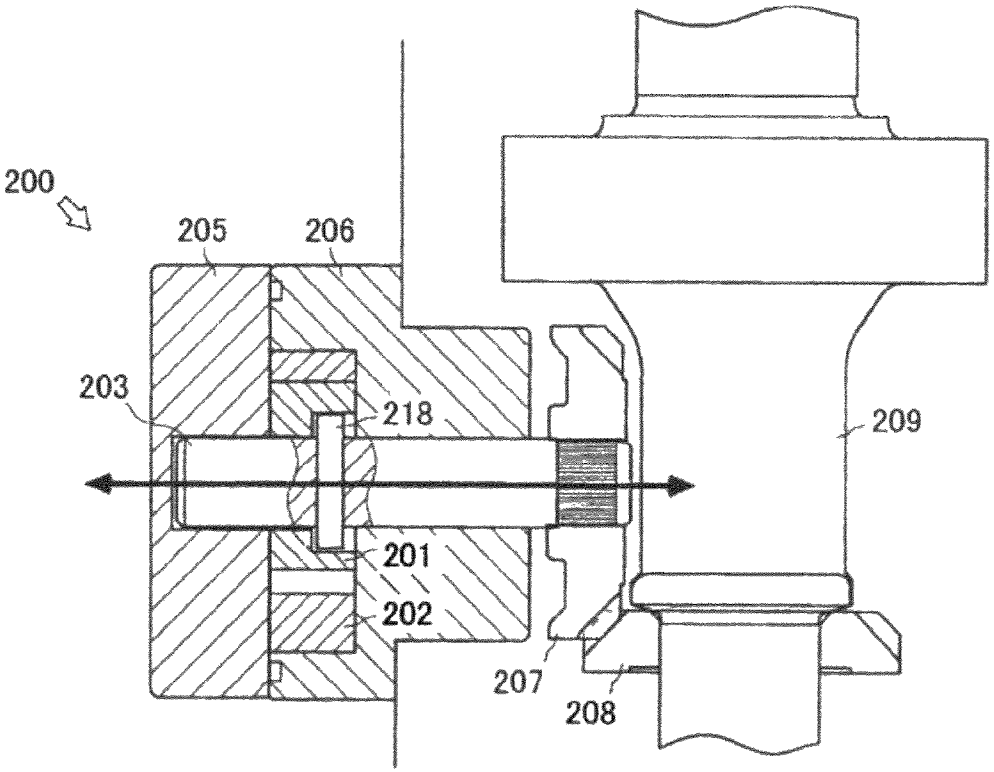
Fig. 14 Prior Art
FIG. 14 is a pattern cross-sectional diagram of a conventional trochoid pump.

FIG. 14 is a pattern cross-sectional diagram of a conventional trochoid pump.

A distributor type pump 250 that a trochoid pump of the present invention is applicable will be briefly described with reference to FIG. 1.

A camshaft 209, which is rotatably supported on the lower side of the distributor type pump 250, is transversely situated. A cam 212 is fixed on the camshaft 209 and a plunger 260 is provided on the upper side of the cam 212. Due to the above construction, the cam 212 and the camshaft 209 are integrally rotatable, and the plunger 260 is vertically movable by rotating the cam 212. A fuel gallery 265 is formed in a housing of the distributor type pump 250.

A distribution shaft 270 is provided parallel to the plunger 260 on the side of the plunger 260, and a driving shaft 203 is connected to the lower side of the distribution shaft 270. The driving shaft 203 is drivingly connected to the camshaft 209 via bevel gears 207 and 208, thereby driving the distribution shaft 270. A trochoid pump 200 is coaxially disposed onto the driving shaft 203 and is driven by the driving shaft 203.

Due to the above construction of the distributor type pump 250, fuel in a fuel tank 291 are pressurized and sent into the fuel gallery 265 through a fuel tubing 292 by the trochoid pump 200 and a feed pump 290. The pressurized fuel are sent into the distribution shaft 270 as the plunger 260 is upwardly moved, and they are further sent in a distribution chase (not shown) provided on the distribution shaft 270. Finally, the fuel are supplied with delivery valves 293 of the respective cylinders. The pressurized fuel supplied with the delivery valves 293 are sent into a injection nozzle 294 and injected from thence.

Next, the trochoid pump 200 according to the present invention will be briefly described with reference to FIG. 2.

The trochoid pump 200 is constituted so that the inner rotor 201 and the outer rotor 202 are embedded with a pump aperture 223 of the casing 206. The inner rotor 201 is rotatably driven by the driving shaft 203. The outer rotor 202 meshed with the inner rotor 201 is rotated in the same direction with the inner rotor 201.

Due to the above construction, a plurality of pump chambers formed between the inner rotor 201 and the outer rotor 202 are movable so as to change the volumes thereof. A fuel oil is inlet from a inlet port 220 formed so that the volumes of the pump chambers are gradually increased, and the fuel oils are discharged from the outlet port 221 formed so that the volumes of the pump chambers are gradually decreased The present invention comprises a trochoid pump, wherein a driving shaft, which a drive gear comprising a bevel gear is fixed on one end thereof and an inner rotor is penetrated onto the other end thereof, an outer rotor, which is decentered to the inner rotor, and wherein both rotors are covered with the cap and the casing, the thrust of the driving shaft is axially regulated by a first regulatory structure, that the driving shaft itself or a means of control fixed on the driving shaft regulates a one-way movement to the casing and by a second regulatory structure, that an end face on the other side of the driving shaft regulates the other way movement of the cap resulting from the joining with one side of the cap.

In this regard, embodiments 1 to 11 according to the trochoid pumps of the present invention will be described below, mainly with pattern cross-sectional diagrams (FIGS. 3 to 13) of the respectively corresponding trochoid pumps 10 to 110.

Hereinafter, with respect to the thrust directions of the driving shafts 13 to 113, the sides of the removable caps 15 to 115 (the observers' left side) are defined as the front sides, and the sides of the drive gears 17 to 117 (the observers' right side) are defined as the rear sides. In other words, with regard to FIGS. 3 to 13, the directions of arrows are the thrust directions and they mean the rear sides.

First Embodiment

As the first embodiment of the present invention, a trochoid pump 10 will be described with reference to the pattern cross-sectional diagram as shown in FIG. 3 (*a*) and the elevational view of the driving shaft 13 to which the inner rotor 11 is attached as shown in FIG. 3 (*b*). The trochoid pump 10 is covered with the casing 16 and the removable cap 15, and with which the inner rotor 11 and the outer rotor 12 are equipped therein.

The driving shaft 13 is constituted as the different diameter shaft 13X so that the diameter from the end of the front side to the midstream thereof is larger than that of the driving shaft 13. In this regard, the portion, which the diameter of the driving shaft 13 is changed, is defined as a stepped section 13 R. In addition, the drive pin 18 is inserted into the midstream of the driving shaft 13 perpendicular to the direction of the shaft center, and engagement portions (not shown), which engage with both ends of the drive pin 18, are formed on the inner surface of the front side of the inner rotor 11.

When the above-mentioned driving shaft 13 is covered with the casing 16 and the cap 15, the end face 13*b* on the rear side of the stepped section 13 R is engaged with the end face 13*a* on the front side of the inner rotor 11, thereby consisting of the first regulatory structure. The end face 13*a* on the front side of the driving shaft 13 is engaged with the inner end face 15*a* of the cap 15, thereby consisting of the second structure.

Due to the above construction, the end face 13*a* on the front side of the driving shaft 13 is engaged with the inner end face 15*a* of the cap 15 toward the front side of the thrust direction of the driving shaft 13, thereby consisting of the second regulatory structure. The end face 13*b* on the rear side of the stepped section 13 R is engaged with the end face 11*b* on the front side of the inner rotor 11, thereby consisting of the first regulatory structure. In other words, the driving shaft 13 is regulated in the thrust direction.

In the embodiment, one portion of the driving shaft 13 is composed of the simple construction as the different diameter shaft 13X, so that the position in the thrust direction of the driving shaft 13 is determined. Thus, even if the drive gear 17 is abraded, the offset of the driving shaft 13 remains unchanged, thereby preventing the increase in the abrasion of the drive gear 17. In addition, the movable scope of the driving shaft 13 can be adjusted by the single piece of the trochoid pump 10, thereby advancing the operability of the trochoid pump 10.

Second Embodiment

As the second embodiment of the present invention, a trochoid pump 20 will be described with reference to the pattern cross-sectional diagram as shown in FIG. 4 (*a*). The trochoid pump 20 is covered with the casing 26 and the removable cap 25, and with which the inner rotor 21 and the outer rotor 22 are equipped therein. The driving shaft 23 is constituted as the different diameter shaft 13X so that the diameter from the end of the front side to the midstream thereof is larger than that of the driving shaft 23. In this regard, the portion, which the diameter of the driving shaft 23 is changed, is defined as a stepped section 23 R. A dihedral portion 23*c*, around the stepped section 23 R of the different diameter shaft 23X, which is formed by removing both sides thereof, is provided as an oval shape on cross section.

Moreover, as shown is FIG. 4 (*b*), the diameter of the inner rotor 21 is composed to be larger than that of the through-hole so that the different diameter shaft 23X is fixed on the front side thereof, and in the inner rotor 21, a joint 21G having a notch 21*c* is provided so that the dihedral portion 23*c* can be engaged with it.

When the above-mentioned driving shaft 23 is disposed on the inner rotor 21, the end face 23*a* on the front side of the driving shaft 23 is engaged with the inner end face 25*a* of the cap 25, and the end face 23*b* on the rear side of the stepped section 23 R is engaged with the end face 21*b* on the rear side of the joint 21G in the inner rotor 21. The dihedral portion 23*c* of the driving shaft 23 is engaged with the notch 21*c* on the joint 21G in the inner rotor 21, thereby transmitting the revolution drive to it.

Due to the above construction, the end face 23*a* on the front side of the driving shaft 23 is engaged with the inner end face 25*a* of the cap 25 toward the front side of the thrust direction, thereby consisting of the second regulatory structure. In addition, the end face 23*b* on the rear side of the stepped section 23 R is engaged with the end face 21*b* on the front side of the joint 21G in the inner rotor 21 toward the rear side of the thrust direction, thereby consisting of the first regulatory structure. In other words, the driving shaft 23 is regulated in the thrust direction.

Moreover, as the dihedral portion 23*c* of the driving shaft 23 is fixed on the joint 21G, the inner rotor 21 is regulated toward the driving shaft 23 in the rotational direction thereof, thereby transmitting the revolution drive to it.

In the embodiment, one portion of the driving shaft 23 is composed of the simple construction as the different diameter shaft 23X, so that the position in the thrust direction of the driving shaft 23 is determined. Thus, even if the drive gear 27 is abraded, the offset of the driving shaft 23 remains unchanged, thereby preventing the increase in the abrasion of the drive gear 27. In addition, the movable scope of the driving shaft 23 can be adjusted by the single piece of the trochoid pump 20, thereby advancing the operability of the trochoid pump 20.

In the embodiment, the rotational direction of the inner rotor 21 toward the driving shaft 23 is regulated by forming the dihedral portion 23*c* on the driving shaft 23 without the conventional drive pin, thereby reducing the number of components of the trochoid pump 20.

Third Embodiment

As the third embodiment of the present invention, a trochoid pump 30 will be described with reference to the pattern cross-sectional diagram as shown in FIG. 5 (*a*). In the trochoid pump 30, the different diameter shaft 23X in the trochoid pump 20 as shown in the second embodiment is substituted for the different diameter shaft 33X that is removable by a bolt 34 in the thrust direction. In other words, the different diameter shaft 33X is constructed to be separable from the driving shaft 33, the through-hole is open into the shaft center portion of the different diameter shaft 33X, a thread-hole is perforated into one end of the driving shaft 33 and can be fixed by an embedded bolt. As shown in FIG. 5 (*c*), the bolt 34 is a hexagon socket head bolt, the ridge of which is penetrated into a depressed portion provided in the different diameter shaft 33X. The bolt 34 is constructed to be removable with a hexagon wrench and the like. As shown in FIGS. 5 (*a*) and (*b*), descriptions of the regulation of driving shaft 33 in the rotational direction and the thrust direction will be omitted because it is the same as that of the second embodiment.

In the embodiment, one portion of the driving shaft 33 is composed of the simple construction as the different diameter shaft 33X that is removable by the bolt 34, so that the position in the thrust direction of the driving shaft 33 is determined. Thus, even if the drive gear 37 is abraded, the offset of the driving shaft 33 remains unchanged, thereby preventing the increase in the abrasion of the drive gear 37. In addition, the movable scope of the driving shaft 33 can be adjusted by the single piece of the trochoid pump 30, thereby advancing the operability of the trochoid pump 30.

In the embodiment, also, the rotational direction of the inner rotor 31 toward the driving shaft 33 is regulated by forming the dihedral portion 33*c* on the driving shaft 33 without the conventional drive pin, thereby reducing the number of components of the trochoid pump 30.

Moreover, as the different diameter shaft 33X is removable by the bolt 34, without the stepped processes on the shaft as the first and second embodiments, the workability can be improved, thereby reducing the number of the fabrication processes. In this regard, as the different diameter shaft 33X is removable by the bolt 34, the trochoid pump 30 can be easily decomposable, even if the drive gear 37 is fixed with expansion fit etc., thereby advancing the maintenance performance.

Fourth Embodiment

As the fourth embodiment of the present invention, a trochoid pump 40 will be described with reference to the pattern cross-sectional diagram as shown in FIG. 6 (*a*). The trochoid pump 40 is covered with the casing 46 and the removable cap 45, and with which the inner rotor 41 and the outer rotor 42 are equipped therein.

With reference to FIGS. 6 (*b*) and (*c*), in the driving shaft 43, a chase is furrowed around the rear side of the cap 45 and into which a horseshoe piece 44 is fixable therein. When the inner rotor 41 is provided on the driving shaft 43, the horseshoe piece 44 is attachable to the position where it is engaged with the front side of the inner rotor 41. A joint 49, which is engageable with a drive pin 48, is provided on the rear side of the inner rotor 41.

When the above-mentioned driving shaft 43 is covered with the casing 46 and the cap 45, the end face 43*a* on the front side of the driving shaft 43 is engaged with the inner end face 45*a* of the cap 45.

Due to the above construction, the end face 43*a* on the front side of the driving shaft 43 is engaged with the inner end face 45*a* of the cap 45 toward the front side of the thrust direction, thereby consisting of the second regulatory structure. The end face 44*b* on the rear side of the horseshoe piece 44 is engaged with the end face 41*b* on the front side of the inner rotor 41 toward the rear side of the thrust direction, thereby consisting of the first regulatory structure. In other words, the driving shaft 43 is regulated in the thrust direction.

In the embodiment, the driving shaft 43 is composed of the simple construction as the horseshoe piece 44, so that the position in the thrust direction of the driving shaft 43 is determined. Thus, even if the drive gear 47 is abraded, the offset of the driving shaft 43 remains unchanged, thereby preventing the increase in the abrasion of the drive gear 47. In addition, the movable scope of the driving shaft 43 can be adjusted by the single piece of the trochoid pump 40, thereby advancing the operability of the trochoid pump 40.

In the embodiment, also, as the horseshoe piece 44 is provided on the driving shaft 43, without the stepped processes on the shaft as the first and second embodiments, the workability can be improved, thereby reducing the number of the fabrication processes.

Moreover, as the horseshoe piece 44 is removable, the trochoid pump 40 can be easily decomposable, thereby advancing the maintenance performance. At the same time, the trochoid pump 40 is easily manufacturable, thereby reducing the number of the fabrication processes.

Fifth Embodiment

As the fifth embodiment of the present invention, a trochoid pump 50 will be described with reference to the pattern cross-sectional diagram as shown in FIG. 7 (*a*). The trochoid pump 50 is covered with the casing 56 and the removable cap 55, and with which the inner rotor 51 and the outer rotor 52 are equipped therein.

In the driving shaft 53, a chase is furrowed around the front side of the inner rotor 51 and into which a horseshoe piece 54 is fixturable therein. A dihedral portion 54*c* is provided on the outer circumference of the horseshoe piece 54

In addition, as shown in FIG. 7 (*b*), a joint 51G, which is engageable with the horseshoe piece 54, is provided on the front side of the inner rotor 51. In the joint 51G, a notch 51*c* is provided so as to fix the dihedral portion 54*c* of the horseshoe piece 54, thereby conforming their forms.

As shown in FIG. 7 (*c*), when the inner rotor is provided on the driving shaft 53, the horseshoe piece 54 is constructed to be fixable with the joint 51G.

When the above-mentioned driving shaft 53 is covered with the casing 56 and the cap 55, the end face 53*a* on the front side of the driving shaft 53 is engaged with the inner end face 55*a* of the cap 55, and the end face 51*b* on the rear side of the horseshoe piece 54 is engaged with the end face 54*b* on the front side of the joint 51G on the inner rotor 51.

Due to the above construction, the end face 53*a* on the front side of the driving shaft 53 is engaged with the inner end face 55*a* of the cap 55 toward the front side of the thrust direction, thereby consisting of the second regulatory structure. The end face 54*b* on the rear side of the horseshoe piece 54 is regulated by the end face 51*b* on the front side of the joint 51G on the inner rotor 51 toward the rear side of the thrust direction, thereby consisting of the first regulatory structure. In other words, the driving shaft 53 is regulated in the thrust direction.

The horseshoe piece 54 is fixed onto the joint 51G, so that the rotational direction of the inner rotor 51 is regulated by the driving shaft 53 and the inner rotor 51 can be rotatably driven.

In the embodiment, the driving shaft 53 is composed of the simple construction as the horseshoe piece 54, so that the position in the thrust direction of the driving shaft 53 is determined. Thus, even if the drive gear 57 is abraded, the offset of the driving shaft 53 remains unchanged, thereby preventing the increase in the abrasion of the drive gear 57. In addition, the movable scope of the driving shaft 53 can be adjusted by the single piece of the trochoid pump 50, thereby advancing the operability of the trochoid pump 50.

In the embodiment, also, the rotational direction of the inner rotor 51 toward the driving shaft 53 is regulated by the dihedral portion 54*c* equipped with the horseshoe piece 54, without the conventional drive pin, thereby reducing the number of components of the trochoid pump 50.

Moreover, the cap 55 is removed and the driving shaft 53 is slided by the thickness of the cap 55 so as to remove the horseshoe piece 54, so that the trochoid pump 50 is easily decomposable, thereby improving the maintenance performance of it.

Sixth Embodiment

As the sixth embodiment of the present invention, a trochoid pump 60 will be described with reference to the pattern cross-sectional diagram as shown in FIG. 8 (*a*). The trochoid pump 60 is covered with the casing 66 and the removable cap 65, and with which the inner rotor 61 and the outer rotor 62 are equipped therein.

As shown in FIG. 8 (*b*), in a specially shaped drive pin 64, a tetrahedral shaped portion 64G comprising of dihedral portions 64*b*, 64*c* is formed on both ends of a normal columnar drive pin (for example, the drive pin 18). In other words, both ends of the specially shaped drive pin 64 are processed into the quadrangle on cross section.

As shown in FIG. 8 (*c*), a joint 61G, which is fixable on the tetrahedral shaped portion 64G of the specially shaped drive pin 64, is formed on the front side of the inner rotor 61.

As shown in FIG. 8 (*d*), when the inner rotor 61 is provided on the above-mentioned driving shaft 63, the tetrahedral shaped portion 64G on the specially shaped drive pin 64 is constructed to be fixed into the joint 61G. In this regard, the dihedral portion 64*b* of the tetrahedral shaped portion 64G of the specially shaped drive pin 64 is constructed to be engageable with the end face 61*b* of the joint 61G, and the dihedral portion 64*c* is constructed to be engageable with the end face 61*c* of the joint 61G.

Due to the above-mentioned construction, the end face 63*a* on the front side of the driving shaft 63 is engaged with the inner end face 65*a* of the cap 65 toward the front side of the thrust direction, thereby consisting of the second regulatory structure. The dihedral portion 64*b* on the rear side of the tetrahedral shaped portion 64G of the specially shaped drive pin 64 is regulated by the end face 61*b* on the front side of the joint 61G toward the rear side of the thrust direction, thereby consisting of the first regulatory structure. In other words, the driving shaft 63 is regulated in the thrust direction.

The tetrahedral shaped portion 64G of the specially shaped drive pin 64 is fixed onto the joint 61G, so that the rotational direction of the inner rotor 61 is regulated by the driving shaft 63.

In the embodiment, the driving shaft 63 is composed of the simple construction as the specially shaped drive pin 64, so that the position in the thrust direction of the driving shaft 63 is determined. Thus, even if the drive gear 67 is abraded, the offset of the driving shaft 63 remains unchanged, thereby preventing the increase in the abrasion of the drive gear 67. In addition, the movable scope of the driving shaft 63 can be adjusted by the single piece of the trochoid pump 60, thereby advancing the operability of the trochoid pump 60.

In the embodiment, also, the rotational direction and the thrust direction of the inner rotor 61 toward the driving shaft 63 is regulated by fabricating the conventional drive pin, thereby providing two functions and reducing the number of components of the trochoid pump 60.

Moreover, the positions in the thrust direction and the rotational direction are adjusted by the shape of the tetrahedral shaped portion 64G of the specially shaped drive pin 64, thereby enhancing the accuracy of the positioning.

Further, because the specially shaped drive pin 64 of the embodiment is tetrahedrally in contact with the inner rotor 61, while the conventional drive pin is tangentially in contact with the engagement portion of the inner rotor, thereby creating more contact areas, decreasing the abrasion of the specially shaped drive pin 64 and the inner rotor 61, as well as improving the durability of them.

Seventh Embodiment

As the seventh embodiment of the present invention, a trochoid pump 70 will be described with reference to the pattern cross-sectional diagram as shown in FIG. 9 (*a*). The trochoid pump 70 is covered with the casing 76 and the removable cap 75, and with which the inner rotor 71 and the outer rotor 72 are equipped therein. The rotational direction of the inner rotor 71 is regulated toward the driving shaft 73 by a drive pin 74.

As shown in FIG. 9 (*b*), the trochoid pump 70 includes a cover 78 that covers with a drive gear 77. The cover 78 has a notch in a portion which contacts with a drive gear (not shown) that transmits the driving of the drive gear 77.

Due to the above construction, the end face 73*a* on the front side of the driving shaft 73 is engaged with the inner end face 75*a* of the cap 75 toward the front side of the thrust direction, thereby consisting of the second regulatory structure. Also, the end face 73*b* on the rear side of the driving shaft 73 is regulated by the inner end face 78*b* of the cover 78 toward the rear side of the thrust direction, thereby consisting of the first regulatory structure. In other words, the driving shaft 73 is regulated in the thrust direction.

In the embodiment, the cover 78 is equipped with the trochoid pump 70, so that the position in the thrust direction of the driving shaft 73 is determined.

Thus, even if the drive gear 77 is abraded, the offset of the driving shaft 73 remains unchanged, thereby preventing the increase in the abrasion of the drive gear 77. In addition, the movable scope of the driving shaft 73 can be adjusted by the single piece of the trochoid pump 70, thereby advancing the operability of the trochoid pump 70.

Eighth Embodiment

As the eighth embodiment of the present invention, a trochoid pump 80 will be described with reference to the pattern cross-sectional diagram as shown in FIG. 10 (*a*). The trochoid pump 80 is covered with the casing 86 and the removable cap 85, and with which the inner rotor 81 and the outer rotor 82 are equipped therein. The rotational direction of the inner rotor 81 is regulated toward the driving shaft 83 by a drive pin 84.

As shown in FIG. 10 (*b*), the trochoid pump 80 includes a cover 88 that covers with a drive gear 87. The cover 88 has a notch in a portion which contacts with a drive gear (not shown) that transmits the driving of the drive gear 87. An adjusting bolt 89 is threadably mounted onto the driving shaft 83 from the center of the cover 88 toward the front side of the thrust direction of the driving shaft 83. In this regard, the end face 89*b* of the adjusting bolt 89 is constructed to be engageable with the end face 83*b* on the rear side of the driving shaft 83.

Due to the above-mentioned construction, the end face 83*a* on the front side of the driving shaft 83 is engaged with the inner end face 85*a* of the cap 85 toward the front side of the thrust direction, thereby consisting of the second regulatory structure. Also, the end face 83*b* on the rear side of the driving shaft 83 is regulated by the end face 89*b* of the adjusting bolt 89 toward the rear side of the thrust direction, thereby consisting of the first regulatory structure. In other words, the driving shaft 83 is regulated in the thrust direction.

In the embodiment, the cover 88 and the adjusting bolt 89 are equipped with the trochoid pump 80, so that the position in the thrust direction of the driving shaft 83 is determined. Thus, even if the drive gear 87 is abraded, the offset of the driving shaft 83 remains unchanged, thereby preventing the increase in the abrasion of the drive gear 87. In addition, the movable scope of the driving shaft 83 can be adjusted by the single piece of the trochoid pump 80, thereby advancing the operability of the trochoid pump 80.

Ninth Embodiment

As the ninth embodiment of the present invention, a trochoid pump 90 will be described with reference to the pattern cross-sectional diagram as shown in FIG. 11. The trochoid pump 90 is covered with the casing 96 and the removable cap 95, and with which the inner rotor 91 and the outer rotor 92 are equipped therein. The rotational direction of the inner rotor 91 is regulated toward the driving shaft 93 by a drive pin 94.

Also, the trochoid pump 90 includes a cover 98 that covers with a drive gear 97. As in the case of the eighth embodiment, the cover 98 has a notch in a portion which contacts with a drive gear (not shown) that transmits the driving of the drive gear 97. Further, at the substantially central portion of the cover 98, a thrust washer 99 is provided toward the front side of the thrust direction of the driving shaft 93. In other words, the thrust washer 99 is interposed between the cover 98 and the driving shaft 93.

Due to the above-mentioned construction, the end face 93*a* on the front side of the driving shaft 93 is engaged with the inner end face of the cap 95 toward the front side of the thrust direction, thereby consisting of the second regulatory structure. Also, the end face 93*b* on the rear side of the driving shaft 93 is regulated via the bounce of the thrust washer 99 toward the rear side of the thrust direction, thereby consisting of the first regulatory structure. In other words, the driving shaft 93 is regulated in the thrust direction.

In the embodiment, the cover 98 and the thrust washer 99 are equipped with the trochoid pump 90, so that the position in the thrust direction of the driving shaft 93 is determined. Thus, even if the drive gear 97 is abraded, the offset of the driving shaft 93 remains unchanged, thereby preventing the increase in the abrasion of the drive gear 97. In addition, the movable scope of the driving shaft 93 can be adjusted by the single piece of the trochoid pump 90, thereby advancing the operability of the trochoid pump 90.

Tenth Embodiment

As the tenth embodiment of the present invention, a trochoid pump 100 will be described with reference to the pattern cross-sectional diagram as shown in FIG. 12. The trochoid pump 100 is covered with the casing 106 and the removable cap 105, and with which the inner rotor 101 and the outer rotor 102 are equipped therein. The rotational direction of the inner rotor 101 is regulated toward the driving shaft 103 by a drive pin 104, so that the inner rotor 101 is constructed to be driven by the driving shaft 103 via the drive pin 104.

An adjusting bolt 108 is provided onto the cap 105 toward the rear side of the thrust direction of the driving shaft 103. In this regard, the adjusting bolt 108, which is facing with the driving shaft 103, is provided onto the cap 105.

Due to the above-mentioned construction, the offset of the end face 103*a* on the front side of the driving shaft 103 is adjusted and regulated by the end face 108*a* of the adjusting bolt 108 toward the front side of the thrust direction. In other words, the driving shaft 103 is regulated in the thrust direction.

In the embodiment, the adjusting bolt 108 is provided onto the cap 105 of the trochoid pump 100, so that the movable scope of the driving shaft 103, with the driving shaft 103 attached to the fuel injection device, can be adjusted from the outside of the device. Accordingly, even if a drive gear 107 is abraded and is offset in the thrust direction, the increase in the abrasion of the drive gear 107 can be prevented by being adjusted the movable scope of the driving shaft 103.

Eleventh Embodiment

As the eleventh embodiment of the present invention, a trochoid pump 110 will be described with reference to the pattern cross-sectional diagram as shown in FIG. 13. The trochoid pump 110 is covered with the casing 116 and the removable cap 115, and with which the inner rotor 111 and the outer rotor 112 are equipped therein. The rotational direction of the inner rotor 111 is regulated toward the driving shaft 113 by a drive pin 114.

Also, an adjusting bolt 118 is provided via a thrust washer 119 onto the cap 115 toward the front side of the thrust direction of the driving shaft 113 covered with the cap 115. In other words, the thrust washer 119 is interposed between the adjusting bolt 118 and the driving shaft 113.

Due to the above-mentioned construction, in the driving shaft 113, the end face 113*a* on the front side of the driving shaft 113 is regulated via the bounce of the thrust washer 119 by the end face 118*a* of the adjusting bolt 118 toward the rear side of the thrust direction. In other words, the driving shaft 113 is regulated in the thrust direction.

In the embodiment, the adjusting bolt 118 is provided via the thrust washer 119 onto the cap 115 of the trochoid pump 110, so that the movable scope of the driving shaft 103 can be adjusted. Accordingly, the increase in the abrasion of the drive gear 107 can be prevented by being adjusted the movable scope of the driving shaft 113, even if a drive gear 107 is abraded and the driving shaft 113 is offset in the thrust direction.

The offset of the driving shaft 103 in the thrust direction can be minimized by the elastic force of the thrust washer 119 while the trochoid pump 110 is driven, thereby reducing the abrasion of the drive gear 117.

INDUSTRIAL APPLICABILITY

The present invention can be available in the trochoid pump of the diesel engine.

The invention claimed is:

1. A trochoid pump, comprising:

a driving shaft;

a drive gear fixed on a first end of the driving shaft, wherein the drive gear comprises a bevel gear;

an inner rotor penetrated onto the second end of the driving shaft;

an outer rotor, the center of which is decentered to the inner rotor; a cap and a casing covering both the inner and outer rotor;

a first regulatory structure configured to constrain movement of the driving shaft in a first axial direction of the casing; and a second regulatory structure configured to constrain movement of the driving shaft, wherein an end face on the second end of the driving shaft is engaged with an end face of the cap in the direction opposite the first axial direction;

the first regulatory structure further comprising:

a specially shaped drive pin having a tetrahedral shaped portion comprising two dihedral portions shaped on both ends of the drive pin, wherein the specially shaped drive pin is inserted into the midstream of the driving shaft; and a joint disposed on the inner rotor, wherein the joint is configured for engagement with the tetrahedral shaped portion, wherein one dihedral portion of the tetrahedral shaped portion of the drive pin is engaged with a surface of the joint in an axial direction of the driving shaft, and the other dihedral portion is engaged with a surface of the joint in a rotational direction of the driving shaft, and wherein the first regulatory structure and the second regulatory structure are configured to reduce backlash between the drive gear and another drive gear caused by axial offset of the driving shaft in a thrust direction.

* * * * *